US005208126A

United States Patent [19]

Tachikawa et al.

[11] Patent Number: 5,208,126

[45] Date of Patent: May 4, 1993

[54] ELECTROPHOTOGRAPHIC PRINTING PLATE PRECURSOR AND PHOTOSENSITIVE LITHOGRAPHIC PRINTING PLATE PRECURSOR

[75] Inventors: Hiromichi Tachikawa; Hiroaki Yokoya, both of Kanagawa; Yoshihiko Urabe, Shizuoka, all of Japan

[73] Assignee: Fuji Photo Film Co., Ltd., Kanagawa, Japan

[21] Appl. No.: 701,721

[22] Filed: May 17, 1991

[30] Foreign Application Priority Data

May 18, 1990 [JP] Japan ..... 2-128587
May 28, 1990 [JP] Japan ..... 2-137886
Jun. 7, 1990 [JP] Japan ..... 2-148953

[51] Int. Cl.[5] ..... G03G 13/28

[52] U.S. Cl. ..... 430/49; 430/96; 430/271

[58] Field of Search ..... 430/49, 96, 271, 272

[56] References Cited

U.S. PATENT DOCUMENTS 3,453,106 7/1969 Teague ..... 430/96
5,069,999 12/1991 Higashi et al. ..... 430/271

FOREIGN PATENT DOCUMENTS 63-178240 7/1988 Japan .
261654 3/1990 Japan .
266566 3/1990 Japan .

*Primary Examiner*—John Goodrow
*Attorney, Agent, or Firm*—Sughrue, Mion, Zinn, Macpeak & Seas

[57] ABSTRACT

A novel electrophotographic printing plate precursor and a novel photosensitive lithographic printing plate precursor are disclosed, in which a specific layer is formed on the end face thereof.

35 Claims, 3 Drawing Sheets

ELECTROPHOTOGRAPHIC PRINTING PLATE PRECURSOR AND PHOTOSENSITIVE LITHOGRAPHIC PRINTING PLATE PRECURSOR

FIELD OF THE INVENTION

The present invention relates to an electrophotographic printing plate precursor and a photosensitive lithographic printing plate precursor, from which a printing plate is prepared by forming toner images on a photoconductive layer and removing the nonimage areas other than the toner image area. More particularly, it relates to an electrophotographic printing plate precursor and a photosensitive printing plate precursor for lithographic platemaking, with which staining in printing can be prevented.

BACKGROUND OF THE INVENTION

Nowadays, presensitized plates (PS plates) and other plates in which positive-type photosensitive materials mainly composed of a diazo dye and a phenolic resin or negative-type photosensitive materials mainly comprising an acrylic monomer or prepolymer are used are in practical use in platemaking for lithographic offset printing. However, such materials are invariably low in sensitivity and therefore platemaking is performed employing contact exposure through film negatives on which images have been preliminarily recorded. On the other hand, recent advances in the technologies of computer-assisted image processing, mass storage of data and data transmission have made it possible to computerize the operations of input of originals, revision, editing, layout and pagination throughout and put into practical use electronic editing systems which can instantly output data on terminal plotters in remote places through high-speed communication or satellite communication networks. In particular, in the field of newspaper printing which requires promptness, electronic editing systems are highly demanded. In the fields where originals are currently stored in the form of films and printing plates are prepared by copying based thereon as demanded, the spread of mass storage media such as optical disks will perhaps lead, in one aspect, to storage of originals as digital data in such recording media.

However, few direct-type plates for platemaking capable of giving printing plates directly from the terminal plotter output have been put into practical use. Accordingly, even where an electronic editing system is operated, it is still a current practice that output data are received on silver salt photographic films and printing plates are prepared by contact exposure of PS plates therethrough. One reason is that direct-type printing plate precursors having sufficiently high sensitivity for making printing plates within a practical time period using the output plotter light source (e.g. He-Ne laser, semiconductor laser) are difficult to develop.

Electrophotographic photosensitive materials are thought to have such a high photosensitivity as to render them capable of providing direct-type printing plates.

As another method of prepafing printing plates using the technique of electrophotography, a process is already known which comprises forming toner images and then removing the nonimage areas of the photoconductive layer. For example, mention may be made of those electrophotographic printing plate precursors that are described in JP-B-37-17162, JP-B-38-6961, JP-B-38-7758, JP-B-41-2426 and JP-B-46-39405 (the term "JP-B" as used herein means an "examined Japanese patent publication") and JP-A-50-19509, JP-A-50-19510, JP-A-52-2437, JP-A-54-145538, JP-A-54-134632, JP-A-55-105254, JP-A-55-153948, JP-A-55-161250, JP-A-57 147656 and JP-A-57-161863 (the term "JP-A" as used herein means an "unexamined published Japanese patent application"), among others.

In the above process, it is necessary to remove the nonimage areas of the electrophotographic photosensitive material by etching for exposing the hydrophilic surface and, therefore, the binder resin is often a binder resin capable of leaving said surface as a result of dissolution or swelling in an alkaline solvent.

However, in printing using the printing plates obtained in the above manner, in particular in newspaper printing on roll-form paper using a rotary press, printing-due staining readily occur on the prints in the regions corresponding to the end portions of the printing plate, although no problem is produced in cases where the paper sheets to be printed do not include such end portion regions, as in printing paper sheets smaller in size than the printing plate using an ordinary sheet press. Such staining is particularly remarkable when development is performed with a toner in the manner of reversal development.

For preventing end region staining due to the lithographic printing plates obtained from electrophotographic plates for lithographic platemaking by reversal development, it has been proposed that an insulating resin layer should be provided on the cut end sides (end faces) of said electrophotographic plates (JP-A-63-178240). This proposal is based on the thought that one cause of printing staining due to lithographic printing plates obtained from electrophotographic plates for lithographic plate by reversal development in the manner mentioned above should be the unnecessary toner adhesion to the cut end faces of the electrophotographic plates in the step of reversal development, which adhesion allows ink to adhere to those portions as well, leading to staining and that application of an insulating resin to the end faces of said electrophotographic plates might prevent the toner from adhering to said portions during reversal development. Other measures have been proposed, as described in JP-A-2-61654 and JP-A-2-66566.

On the other hand, photosensitive plates for lithographic platemaking (photosensitive lithographic printing plate precursor) whose support is an aluminum plate are commercially available as PS (presensitized) plates and are in wide use.

Printing with the printing plates prepared from PS plates by imagewise exposure, development and other processings encounters the same problem. Ink adhering to the end portions is also transferred to paper, causing staining and thereby seriously impairing the commercial value of the prints.

One known method of preventing such staining of the end portions of printing plates comprises rounding off the angles from the end portions of the aluminum support by-means of a file or knife, as disclosed in JP-B-57-46754. This method has a drawback in that the printing plates should be rounded off one by one or, in other words, said method is not suited for large quantity processing.

Furthermore, JP-A-59-97146 proposes a method suited for mass production which comprises treating the end faces of photosensitive plates for lithographic platemaking for desensitization. The desensitizing composition is mainly composed of a hydrophilic resin and a strongly acidic compound. This method, however, can solve the end portion staining only to an unsatisfactory extent.

The present inventors found that even when such measures as mentioned above are taken, printing-due end region staining still occurs when lithographic printing plates obtained by toner image formation by reversal development and the subsequent removal of the nonimage areas of the photoconductive layer are used in printing newspapers and so on. The present inventors investigated the causes thereof and, as a result, found that when an insulating layer is provided, as mentioned above, substantially no toner adheres to the end faces but the insulating resin layer itself remains on the end faces and allows ink adhesion, hence printing staining. In other words, it was found that while the insulating resin layer formed on the end faces indeed prevents toner adhesion to the end faces in the step of reversal development, it itself has oleophilic property (namely ink receptivity) and therefore, if it remains, it allows ink adhesion to the end faces, thus failing to prevent printing staining.

Furthermore, the advent of PS plates free from end portion staining and suited for mass production is desired.

SUMMARY OF THE INVENTION

It is an object of the invention to provide an electrophotographic printing plate precursor and a photosensitive lithographic printing plate precursor with which the above-mentioned difficulties can be overcome.

For achieving the above object, the present invention provides:

(1) An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that a layer containing a polymer having at least a polysiloxane structure is formed at the end face of the plate precursor;

(2) An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that a solution containing a silicate of formula: $mSi_2/nM_2O$ (wherein M is an alkali metal atom and the ratio of m/n is 0.5 to 8.5) and a hydrophilic resin is coated on the end face of the plate precursor and further a layer containing at least a polysiloxane structure is formed thereon;

(3) An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that the end face of the plate precursor is desensitized and further a layer containing at least a polysiloxane structure is formed thereon;

(4) An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that an aqueous solution containing a silicate of formula: $mSiO_2/nM_2O$ (wherein M is an alkali metal atom and the ratio of m/n is 0.5 to 8.5) and a hydrophilic resin is coated on the end face of the plate precursor;

(5) An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that an aqueous solution containing a silicate of formula: $mSiO_2/nM_2O$ (wherein M is an alkali metal atom and the ratio of m/n is 0.5 to 8.5) and a hydrophilic resin is coated on the end face of the plate precursor and further an insulating resin is coated thereon; and (6) A photosensitive lithographic printing plate precursor comprising a photosensitive layer on a conductive support having a hydrophilic surface, characterized in that an aqueous solution containing a silicate of formula: $mSiO_2/nM_2O$ (wherein M is an alkali metal atom and the ratio of m/n is 0.5 to 8.5) and a hydrophilic resin is coated on the end face of the plate precursor.

BRIEF DESCRIPTION OF THE DRAWINGS

FIG. 1 shows an electrophotographic printing plate precursor for lithographic platemaking in which a layer containing a polymer having a polysiloxane structure is singly provided on the cut end faces of the plate precursor.

FIG. 2 shows an electrophotographic printing plate precursor for lithographic platemaking in which a layer for desensitization is provided on such end faces and in which a layer containing a polymer having a polysiloxane polymer is further provided on said desensitizing layer.

FIG. 3 shows an electrophotographic printing plate precursor for lithographic platemaking in which a silicate-hydrophilic resin layer is provided on such end faces and in which a layer containing a polymer having a polysiloxane structure is further provided on said layer.

Figure 1:
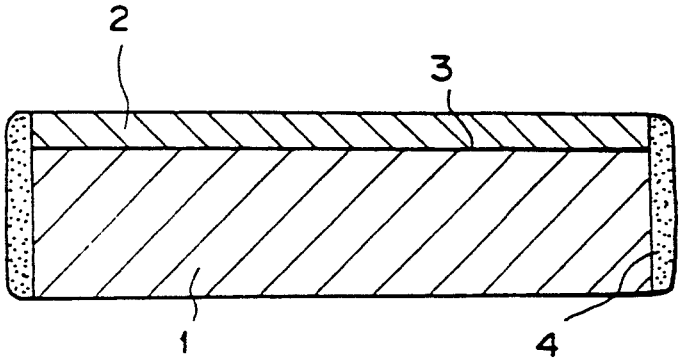
FIGS. 1 to 3 schematically show three different embodiments of the invention.

In the figures, the numeral 1 stand for a support, 2 for a photoconductive layer, 3 for a hydrophilic surface, 4 for a polysiloxane polymer-containing layer, 5 for a desensitizing layer, 6 for a silicate and water-soluble resin layer, and 7 for a photosensitive layer.

DETAILED DESCRIPTION OF THE INVENTION

The conductive support of the electrophotographic printing plate precursor to be used in the practice of the present invention may be any of various supports, inclusive of plastic sheets having a conductive surface, paper species, in particular, made conductive and impermeable to solvents, conductive supports having a hydrophilic surface such as aluminum plates, zinc plates, bimetallic plates (e.g., copper-aluminum plates, copper-stainless steel plates, chromium-copper plates), and tri-metallic plates (e.g., chromium-copper-aluminum plates, chromium-lead-iron plates, chromium-copper-stainless steel plates). The plate preferably has a thickness of 0.1 to 3 mm, more preferably 0.1 to 0.5 mm. Among the supports specifically mentioned above, aluminum plates are most suitably used. The aluminum plates to be used in the practice of the invention are made of pure aluminum or aluminum alloys containing a trace amount of another atom or other atoms. The composition of the material is not limited to a particular one but any material so far known and used can appropriately be used.

The aluminum plates can be used after conventional surface treatments by sand blasting for surface roughening (graining) and by anodizing. For removing the grease, oil or fatty material used in rolling from the aluminum plate surface prior to surface roughening, degreasing treatment with a surfactant or an aqueous alkaline solution is performed as desired, which is then followed by surface roughening. The surface roughening includes mechanical surface roughening, electrochemical surface dissolution and selective chemical surface dissolution. For mechanical surface roughening, such known techniques as ball graining, brush graining, blasting and buffing can be employed. The electrochemical surface roughening may be carried out in a hydrochloric or nitric acid-containing electrolytic solution using an alternating or direct current. The combined use of both can also be made as disclosed in JP-A-54-63902.

The surface-roughened aluminum plates are subjected to alkali etching treatment and neutralization treatment as necessary.

The thus-treated aluminum plates are then subjected to anodic oxidation (anodizing). As the electrolyte to be used in anodizing, there may be mentioned sulfuric acid, phosphoric acid, oxalic acid, chromic acid, and mixtures of these. The concentration of the electrolyte should be selected appropriately depending on the electrolyte species. The anodizing conditions to be employed may vary depending on the electrolyte, hence cannot be specified. Generally, however, an electrolyte concentration of 1-80% by weight, a bath temperature of 5-70° C., a current density of 5-60 A/dm$^2$, a voltage of 1-100 V and an electrolysis time of 10 seconds to 50 minutes are preferred. The extent of anodizing should preferably amount to 0.1-10 g/m$^2$, more preferably 1-6 g/m$^2$.

The polymer having a polysiloxane structure (hereinafter referred to as "polysiloxane polymer") to be used for layer formation on the end faces is now explained. The polysiloxane polymer, so called herein, is a polymer having a repeating structure of silicon-oxygen bonding (—Si—O—) in the main chain and includes polymers generally called silicones.

Thus, said polymer may be a homopolymer, a copolymer, or one having a crosslinked structure, provided that it has at least the above structure. The copolymer may include block, graft and other copolymers composed of polysiloxanes and other polymers than polysiloxanes. These are generally known as silicone oils, organic modified silicone oils, silicone greases, silicone rubbers and silicone resins.

In the following, a more detailed description is given of the polysiloxane polymer. Those polysiloxane polymers that are generally known as silicone oils or silicone greases chemically belong to the class of linear organopolysiloxanes. The term "linear organopolysiloxanes" as used herein refers to linear polymers having a repeating unit of the general formula given below, wherein $R^1$ and $R^2$ each is a hydrogen atom or a $C_{1-10}$ alkyl, vinyl, $C_{6-20}$ aryl or $C_{7-20}$ aralkyl group, which may optionally have one or more appropriate substituents. $R^1$ and $R^2$ may be the same or different. The polymer main chain may contain different repeating units or, in other words, the polymer may be a copolymer.

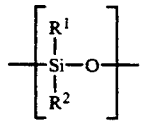

The above-mentioned substituents are not restricted to any specific class but may include, for example, amino, epoxy, carboxy, mercapto, hydroxyl, halogen, polyhaloalkyl, vinyl, and polyether structure-containing groups.

The silicone polymers that are known as silicone rubbers or silicone resins are three-dimensionally crosslinked polymers and can be synthesized by cross-linking the above-mentioned linear organopolysiloxanes. Known methods of crosslinking include peroxide-induced crosslinking, condensation crosslinking, hydrosilylation, addition reaction, ultraviolet-induced crosslinking and electron beam-induced crosslinking, among others. Any of these crosslinking methods may be used for synthesizing the crosslinked polymers mentioned above for use in the practice of the invention.

In peroxide-induced crosslinking, a peroxide is used as an initiator for crosslinking the linear organopolysiloxanes. This method can crosslink linear organopolysiloxanes having no particular functional group. Generally, however, polysiloxanes having a vinyl group, which is highly reactive with radicals, in the side chain are used.

In condensation crosslinking, a condensation-type crosslinking agent or a condensate thereof is added to a linear organopolysiloxane having a hydroxyl group on each end, with a catalyst also added as necessary, and a condensation reaction is carried out for effecting crosslinking. Preferred as the condensation-type crosslinking agent are represented by the following general formula:

$$R_m Si x_n$$

wherein m and n are integers provided that $m+n=4$ and $n \geqq 1$, and R has the same meaning as $R^1$ defined hereinbefore. X is such a substituent as mentioned below:

(1) A halogen atom, such as Cl, Br or I;

(2) OH or an organic functional group, such as $OCOR^3$, $OR^4$,

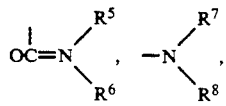

etc., in which $R^3$ to $R^8$ each is an unsubstituted or substituted $C_{1-12}$ alkyl group.

The catalyst to be used in conducting such condensation-type crosslinking is, for example, an organic carboxylic acid salt of a metal (e.g. tin, zinc, lead, calcium or manganese), such as dibutyltin dilaurate, stannous octoate or lead naphthenate, or platinum chloride.

The crosslinking by hydrosilylation gives silicone rubbers as a result of addition reaction between the SiH group and —CH=CH—. The hydrosilylation reaction is carried out using a linear organopolysiloxane containing two or more vinyl groups as substituents and, as a crosslinking agent, a siloxane oligomer having two or more Si—H groups, with a catalyst further added as necessary. Thus, the following composition may be mentioned as an example:

| | | |
|---|---|---|
| (1) | Organopolysiloxane having at least two $C_{2-7}$ alkenyl (preferably vinyl) groups directly bound to the respective silicon atoms per molecule | 100 parts by weight |
| (2) | Organohydrogenpolysiloxane having at least two SiH bonds per molecule | 0.1–1,000 parts by weight |
| (3) | Addition catalyst | 0.00001–10 parts by weight |

The alkenyl groups in component (1) may occur at the ends or in the molecular chain. As other organic groups than alkenyl groups, there may be mentioned substituted or unsubstituted $C_{1-12}$ alkyl or $C_{6-20}$ aryl groups. The component (1) may contain the hydroxyl group in trace amounts. The reactive hydrogen in component (2) may occur at the ends or in the molecular chain and, as other organic groups than hydrogen, there may be mentioned those mentioned above in relation to component (1).

Specific examples of component (1) are $\alpha\omega$-divinylpolydimethylsiloxane, methylvinylsiloxane-dimethylsiloxane copolymers methyl-terminated at both ends, and the like. Examples of component (2) are polydimethyl siloxane hydroxyl-terminated at both ends, $\alpha\omega$-dimethylpolymethylhydrogensiloxane, methylhydrogensiloxane-dimethylsiloxane copolymers methyl-terminated at both ends, cyclic polymethylhydrogensiloxane, and the like.

The addition catalyst, namely component (3), is optionally selected from among known ones, preferably platinum compounds such as platinum, platinum chloride, chloroplatinic acid, and olefin-coordinated platinum. For controlling the rate of curing of these compositions, a crosslinking inhibitor, such as a vinyl-containing organopolysiloxane (e.g. tetracyclo(methylvinyl)-cyclohexane), a carbon-carbon triple bond-containing alcohol, acetone, methyl ethyl ketone, methanol, ethanol, propylene glycol monomethyl ether, may be added.

The three-dimensionally crosslinked polysiloxane polymers illustrated above may be produced by applying a silicone rubber precursor composition prepared by mixing the components required for the crosslinking for three-dimensional polymer formation together and then allowing to stand at room temperature or heating the applied layer for three-dimensionally crosslinked polysiloxane polymer formation.

In the practice of the invention, the electrophotographic printing plate precursor for lithographic platemaking as prepared in the manner mentioned hereinbefore is cut to a desired size, a number of the resulting pieces are piled up, and the cut end faces thereof are coated with a liquid composition containing the above-mentioned polysiloxane polymer or a precursor therefor. Although such method of treatment in the piled-up state is preferred for the purpose of mass production, said composition may be applied to the cut end faces of each individual piece in the piece-by-piece manner.

The polysiloxane polymer or a precursor therefor can be applied by any of the conventional methods, for example by means of a brush, sponge, roller, or the like, or by spray coating. The end face or faces to be coated may vary depending on the mode of use of the printing plates. In cases where only one end face is involved in printing, it is sufficient that said end face alone be coated. When various modes of use are taken into consideration, however, two opposite cut end faces should preferably be coated and, more preferably, the peripheral edges, namely all the four cut end faces, should be coated.

In the practice of the invention, an aqueous solution containing a silicate salt of the general formula $mSiO_2/mM_2O$ (wherein M is an alkali metal atom and the ratio m/n is 0.5 to 8.5) and a hydrophilic resin may be applied for the formation of a layer under the polysiloxane polymer-containing layer.

Furthermore, in the practice of the invention, the end faces may be desensitized against fatty or greasy materials by applying a desensitizing composition for the formation of a layer under the polysiloxane polymer-containing layer.

Such treatments can result in successful prevention of staining in printing even if the upper polysiloxane polymer-containing layer should be lost during printing.

The silicate-containing and water-soluble resin-containing aqueous solution to be used in the practice of the invention and application thereof are now described in further detail.

In the practice of the invention, sodium silicate, potassium silicate, lithium silicate and the like can be used as the silicate, and the mole ratio m/n in $mSiO_2/nM_2O$ is preferably within the range of 0.5–8.5.

The silicate content in the aqueous solution containing such silicate alone or in combination with a hydrophilic resin should recommendably be within the range of about 0.4–40% by weight, preferably about 0.8–25% by weight, on the whole aqueous composition basis.

As examples of the hydrophilic resin which can be used in the practice of the invention, there may be mentioned the following: naturally occurring macromolecules, inclusive of starches, such as sweet potato starch, potato starch, tapioca starch, wheat starch, corn starch, etc., macromolecules of an algal origin, such as carrageenan, laminaran, seaweed mannan, gloiopeltis glue, Irish moss, agar, sodium alginate, etc., plant-derived mucilages, such as hibiscus mucilage, mannan, quince seed, pectin, tragacanth gum, karaya gum, xanthan gum, guar bean gum, locust bean gum, gum arabic, carob gum, gum benzoin, etc., modified mucilages produced by utilizing microbial fermentation or the like, such as dextran, glucan, levan, other like homopolysaccharides, succinoglucan, xanthan gum, other like heteropolysaccharides, etc., and proteins, such as glue, gelatin, casein, collagen, etc.; semisynthetic (seminatural) products, inclusive of propylene glycol alginate ester, cellulose derivatives, such as viscose, methylcellulose, ethylcellulose, methylethylcellulose, carboxymethylcellulose, hydroxypropylcellulose, hydroxypropylmethylcellulose, hydroxypropylethylcellulose, hydroxypropylmethylcellulose phthalate, etc., and modified starches, for example roasted starches, such as white dextrin, yellow dextrin, British gum, etc., enzymatically modified dextrins, such as enzyme-converted dextrin, Schardinger dextrin, etc., acid-processed starches, such as soluble starch etc., oxidized starches, such as dialdehyde starch etc., alpha-form starches, such as modified alpha-form starch, unmodified alpha-form starch, etc., starch esters, such as starch phosphate, starch fatty acid ester, starch sulfate, starch nitrate, starch xanthate, starch carbamate, etc., starch ethers, such as carboxyalkylstarch, hydroxyalkylstarch, sulfoalkylstarch, cyanoethylstarch, allylstarch, benzylstarch, carbamylethylstarch, dialkylaminostarch, etc., crosslinked starches, such as methylol-crosslinked starch, hydroxyalkyl-crosslinked starch, phosphoric acid-crosslinked starch, dicarboxylic acid-crosslinked starch, etc., and starch-derived graft copolymers, such as starch-polyacrylamide copolymer, starch-polyacrylic acid copolymer, starch-polyvinyl acetate copolymer, starch-polyacrylonitrile copolymer, cationic starch-polyacryl acid ester copolymer, cationic starch-vinyl polymer copolymer, starch-polystyrene-maleic acid copolymer, starch-polyethylene oxide copolymer, etc.; and synthetic products, inclusive of polyvinyl alcohol, modifications of polyvinyl alcohol, such as partially acetalized polyvinyl alcohol, allyl-modified polyvinyl alcohol, polyvinyl methyl ether, polyvinyl ethyl ether, polyvinyl isobutyl ether, etc., polyacrylic acid derivatives and polymethacrylic acid derivatives, such as sodium polyacrylate, partially saponified polyacrylic acid ester, partially saponified polyacrylic acid ester copolymer, polymethacrylic acid salt, polyacrylamide, etc., polyethylene glycol, polyethylene oxide, polyvinylpyrrolidone, polyvinylpyrrolidone-vinyl acetate copolymer, carboxyvinyl polymer, styrene-maleic acid copolymer, styrene-crotonic acid copolymer, and so forth.

The hydrophilic resin content in the silicate- and hydrophilic resin-containing aqueous solution to be used in the practice of the invention is recommendably within the range of about 1–30% by weight, preferably about 3–25% by weight, on the whole aqueous composition basis. At addition levels below 1% by weight, the effect of the resin will be slight while, at addition levels exceeding 30% by weight, the aqueous solution will acquire an increased viscosity and become difficult to handle. The hydrophilic resins mentioned above may be used either alone or in combination in the form of a mixture of two or more of them.

In the practice of the invention, an insulating resin layer may further be provided on the hydrophilic resin layer mentioned above. The insulating resin layer can markedly improve, namely suppress, toner adhesion to the cut end faces of the printing plate during reversal development, hence can prevent staining due to cut end faces during printing.

Known synthetic or naturally occurring resins can be used as the insulating resin. For example, there may be mentioned acrylic resins derived from methacrylic acid, acrylic acid and esters of these, vinyl acetate resins, vinyl chloride resins, vinylidene chloride resins, vinyl acetal resins, polystyrene resins, polyester resins, phenolic resins, xylene resins, alkyd resins, cellulose ester derivatives, waxes, polyolefins and the like. This insulating layer should preferably be removed in the manner of etching simultaneously with etching treatment of the photoconductive layer following development with a toner. For this reason, the insulating resin mentioned above should preferably be an alkali-soluble resin dissoluble in the etching solution. Thus, for instance, there may be mentioned copolymers of acrylate esters, methacrylate esters, styrene, vinyl acetate and/or the like, on one hand and a carboxy-containing monomer or acid anhydride group-containing monomer, such as acrylic acid, methacrylic acid, itaconic acid, crotonic acid, maleic acid, maleic anhydride, fumaric acid, etc., on the other, for example styrene-maleic anhydride copolymer, styrene-maleic anhydride monoalkyl ester copolymer, methacrylic acid-methacrylate ester copolymer, styrene-methacrylic acid-methacrylate ester copolymer, acrylic acid-methacrylate ester copolymer, styrene-acrylic acid-methacrylate ester copolymer, vinyl acetate-crotonic acid copolymer, vinyl acetate-crotonic acid-methacrylate ester copolymer, etc., as well as copolymers containing methacrylamide, vinylpyrrolidone or a monomer having a phenolic hydroxy group, sulfone group, sulfonamido group or sulfonimido group, phenolic resins, partially saponified vinyl acetate resins, xylene resins, polyvinylbutyral and other vinyl acetal resins. Copolymers containing, as a comonomer, a monomer having an acid anhydride group or a carboxy group, and phenolic resins can provide high charge-retention capacity of the photoconductive layer of the resulting electrophotographic photographic material and accordingly can be used with good results.

Among the copolymers containing, as a comonomer, a monomer having an acid anhydride group, styrene-maleic anhydride copolymer is preferred. A half ester of this copolymer can also be used. Among the copolymers containing, as a comonomer, a carboxy-containing monomer, copolymers from at least two comonomers, namely acrylic or methacrylic acid and an alkyl, aryl or aralkyl ester of acrylic or methacrylic acid, are preferred. Vinyl acetate-crotonic acid copolymer and vinyl acetate-carboxylic acid ($C_{2-18}$) vinyl estercrotonic acid copolymer (terpolymer) are also preferred examples. Preferred species among the phenolic resins are novolak resins obtained by condensation of phenol, o-cresol, m-cresol or p-cresol with formaldehyde or acetaldehyde under acidic conditions. These resins may be used either alone or in combination.

As the solvent to be used in preparing an insulating resin coating solution, there may be mentioned, among others, halogenated hydrocarbons, such as dichloromethane, dichloroethane, chloroform, etc., alcohols, such as methanol, ethanol, etc., ketones, such as acetone, methyl ethyl ketone, cyclohexanone, etc., glycol ethers, such as ethylene glycol monomethyl ether, 2-methoxyethyl acetate, etc., ethers, such as tetrahydrofuran, dioxane, etc., and esters, such as ethyl acetate, butyl acetate, etc.

In the practice of the invention, the treatment for desensitization against greasy substances is carried out by applying a solution suited for said desensitization treatment to the end faces of the hydrophilic support. As the desensitizing solution, any of the solutions known to be effective in such desensitization of the hydrophilic support of a lithographic printing plate can be used effectively. Particularly favorable results are produced by an aqueous solution containing a hydrophilic organic macromolecular compound. Typical examples of the hydrophilic organic macromolecular compound are gum arabic, dextrin, alginates such as sodium alginate etc., water-soluble cellulose derivatives such as carboxymethylcellulose, hydroxyethylcellulose, hydroxypropylmethylcellulose, etc., polyvinyl alcohol, polyvinylpyrrolidone, polyacrylamide, acrylamide unit-containing water-soluble copolymers, polyacrylic acid, acrylic acid unit-containing copolymers, polymethacrylic acid, methacrylic acid unit-containing copolymers, vinyl methyl ether-maleic anhydride copolymer, vinyl acetate-maleic anhydride copolymer, and phosphoric acid-modified starch. Among these, gum arabic, which has .a strong desensitizing activity, is preferred. These hydrophilic macromolecular compounds are used at a concentration of about 5–40% by weight, preferably 8–30% by weight, if necessary combinedly as a mixture of two or more.

The above-mentioned desensitizing aqueous solution containing a hydrophilic macromolecular compound, which is to be used in the practice of the invention, should preferably contain a metal salt of a strong acid as well. Such salt can increase the desensitizing effect. As examples of the strong acid metal salt, there may be mentioned sodium, potassium, magnesium, calcium and zinc salts of nitric acid, of sulfuric acid, and of chromic acid, as well as sodium fluoride and potassium fluoride. These strong acid metal salts may be used in combination. They are used in an amount of about 0.01–5% by weight on the whole desensitizing solution basis.

When the hydrophilic macromolecular compound contained in the desensitizing solution to be used in the invention is gum arabic, the pH is adjusted to a value in the acidic range, preferably to 1–5, more preferably to 2–4.5. Therefore, in case the pH of the aqueous phase is not acidic, an acid is further added to the aqueous phase. Examples of the acid to be added as a pH adjusting agent are inorganic acids, such as phosphoric acid, sulfuric acid, nitric acid, etc., and organic acids, such as citric acid/ tannic acid, malic acid, glacial acetic acid, lactic acid, oxalic acid, p-toluenesulfonic acid, organic phosphonic acids, etc. Among these, phosphoric acid is particularly preferred since it functions not only as a pH adjusting agent but also as a desensitization effect potentiator. Phosphoric acid is used preferably in an amount of 0.01–8% by weight, more preferably 0.1–5% by weight on the whole desensitization solution basis.

The desensitizing solution to be used in the practice of the invention preferably contains a wetting agent and/or a surfactant, which improves the spreadability of the desensitizing solution. Preferred as the wetting agent are lower polyhydric alcohols, such as ethylene glycol, diethylene glycol, triethylene glycol, propylene glycol, butylene glycol, pentanediol, hexylene glycol, tetraethylene glycol, polyethylene glycol, dipropylene glycol, tripropylene glycol, glycerol, sorbitol, pentaerythritol, etc. Glycerol is most preferred, however.

Usable as the surfactant are nonionic surfactants, such as polyoxyethylene alkylphenyl ether, polyoxyethylene-polyoxypropylene block copolymer, etc., anionic surfactants, such as fatty acid salts, alkyl sulfate ester salts, alkylbenzenesulfonic acid salts, alkylnaphthalenesulfonic acid salts, dialkyl sulfosuccinate ester salts, alkyl phosphate ester salts, naphthalenesulfonic acid-formaldehyde condensates, etc., and amphoteric surfactants of the betaine type, glycine type, alanine type, or sulfobetaine type, for instance.

These wetting agents and/or surfactants are used at an addition level of about 0.5–10% by weight, preferably 1–5% by weight, on the whole desensitizing solution basis.

The desensitizing solution to be used in the practice of the invention may further contain fillers, such as silicon dioxide, talc, clay, etc., in an amount up to 2% by weight and dyes or pigments in an amount up to 1% by weight.

In treating the electrophotographic photosensitive material with the desensitizing solution such as mentioned above for the desensitization of the cut end faces thereof, said desensitizing solution may be applied to the end faces in question of each individual piece of said material. Preferably, however, a large number of pieces (e.g. 1,000 pieces) are piled up and the cut end faces thereof are coated with said solution in that state.

In the practice of the invention, an desensitizing solution, or a solution containing a silicate and a water-soluble resin, is applied to the cut end faces of electrophotographic printing plate precursors for lithographic platemaking, as mentioned above, and, after drying of the coats, a polysiloxane-containing layer is formed thereon.

The desensitizing solution, or the silicate-containing and water-soluble resin-containing solution, is applied to the end faces preferably in a coating amount of about 50–150 g/m$^2$ (as solution).

The thickness of the coat layer containing the polysiloxane polymer according to the invention is preferably within the range of 0.1–30 μm, more preferably 0.5–10 μm.

Figure 2:
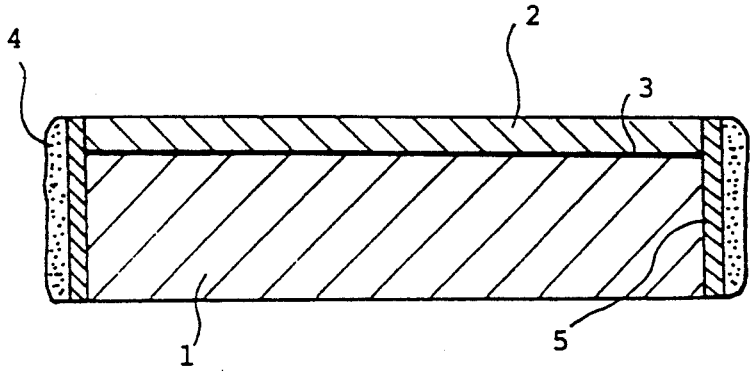
Figure 3:
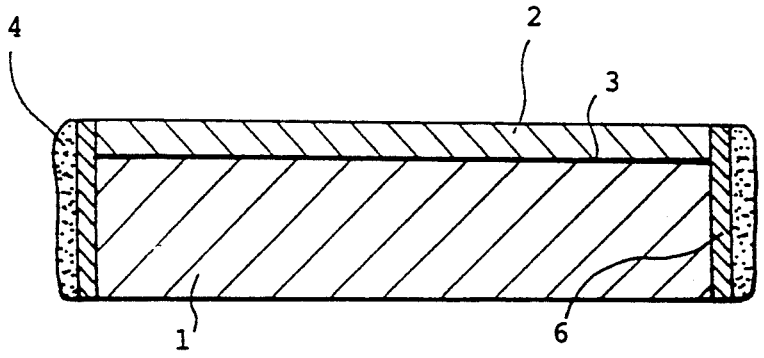

Referring to FIG. 1, which is a schematic representation of an electrophotographic printing plate precursor for lithographic platemaking according to the invention, a support 1 has a photoconductive layer 2 formed on a hydrophilic surface 3 of the support 1 together with a polysiloxane polymer-containing coat layer 4 formed on the end faces of the support. In FIG. 2, which shows another embodiment of the invention, a support 1 has a photoconductive layer 2 formed on a hydrophilic surface 3 of the support together with a desensitizing coat-layer 5 and a polysiloxane polymer-containing coat layer 4 on each end face. In FIG. 3, which shows a further embodiment of the invention, a support 1 has a photoconductive layer 2 formed on a hydrophilic surface 3 of the support together with a silicate-containing and water-soluble resin-containing layer 6 and a polysiloxane polymer-containing layer 4 on each end face.

Figure 4:
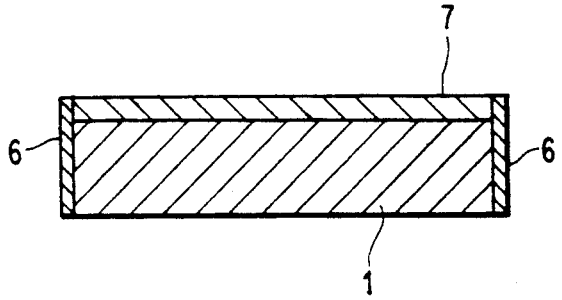
FIG. 4 schematically shows, in section, a PS plate according to the invention.

On the other hand, in FIG. 4, which is a schematic representation of a PS plate, an aluminum support 1 has a photosensitive layer 7 thereon and the end faces each has a coat layer 6 comprising a hydrophilic resin and a silicate as formed by applying thereto a hydrophilic resin solution in accordance with the invention.

The PS plate to which the present invention is applicable includes various plates in which the support is an aluminum plate and in which the photosensitive layer comprises a diazo resin and a hydrophobic resin, or an o-quinonediazide compound and a novolak resin, or a photopolymerizable composition composed of an addition-polymerizable unsaturated monomer, a photopolymerization initiator and an organic macromolecular compound (binder), or a photosensitive resin having a —CH=CH—CO—bonding in its molecule and capable of undergoing a photocrosslinking reaction, for instance.

For improving the spreadability of the silicate- and hydrophilic resin-containing solution, of the insulating resin solution or of the polysiloxane polymer in the practice of the invention or for other purposes, various surfactants and other additives may be used.

For example, the addition of a surfactant improves the surface state of the coat layer, among others. Usable surfactants include anionics, nonionics, amphoterics and cationics.

The anionics include, among others, fatty acid salts, alkylbenzenesulfonates, linear alkylbenzenesulfonates, alkyl sulfate salts, alphaolefinsulfonates, alkyl phosphate ester salts, dialkyl sulfosuccinate salts, polyoxyethylene alkyl ethers, sulfate salts, polyoxyethylene alkyl ether phosphate salts, alkylnaphthalenesulfonates, N-lauroylsarcosine salts, naphthalene-formaldehyde condensate-sulfonates, and diphenyl ether-disulfonates. The nonionics include, among others, polyoxyethylene alkyl ethers, polyoxyethylene alkylphenyl ethers, polyoxyethylene-polyoxypropylene block polymers, polyoxyethylenesorbitan fatty acid esters, polyoxyethyleneglycerol fatty acid esters, polyethylene glycol fatty acid esters, polyoxyethylenefatty amines, fatty acid monoglycerides, sorbitan fatty acid esters, pentaerythritol fatty acid esters, sucrose fatty acid esters, and amine oxides.

The amphoterics may be of the alkylcarboxybetaine type, alkylaminocarboxylic acid type, alkylimidazoline type, or the like. The cationics include tetraalkylammonium salts, trialkylbenzylammonium salts, alkylimidazolinium salts, and the like. Furthermore, there may be mentioned fluorine-containing surfactants and silicone surfactants.

Among the surfactants, anionic and/or nonionic surfactants are particularly effective. These surfactants may be used either alone or two or more of them may be used combinedly. Their concentration is not critical but preferably is within the range of 0.01–10% by weight for each treatment solution.

The silicate-containing treatment solution to be used in the practice of the invention may have a pH of 8–14, preferably 9–13.

In the practice of the invention, the silicate-hydrophilic resin solution or insulating resin solution may be applied by any method well known in the art, for example using a brush, sponge, roller or the like or by spray coating. The end face or faces to be coated may be selected depending on the mode of use of the printing plate. When only one end face is involved in printing, it is sufficient to coat said one face alone with the above-mentioned solution or solutions. Taking various modes of use into consideration, however it is preferable to coat the two opposing end faces or, more preferably, all the peripheral end faces (namely all the four end faces).

In applying the above-mentioned solution or solutions to the end faces, the solution or solutions may be applied to the end face or faces of each individual plate (precursor) one by one. Preferably, however, a large number of photosensitive plates (e.g. 1,000 plates) are piled up and the end faces thereof are coated in that state. In this case, it is of course possible to perform the application using a laminated paper inserted between each neighboring plates, as described in JP-B-57-23259 and JP-A-57-99647. Each solution is applied to the end faces preferably in an amount of about 50–150 g/m$^2$ (as solution).

A large number of compounds so far known to be useful as photoconductive materials can be used as the photoconductive materials in the practice of the invention. Thus, for example, the following may be used.

1) Triazole derivatives described, for example, in U.S. Pat. No. 3,112,197;

2) Oxadiazole derivatives described, for example, in U.S. Pat. No. 3,189,447;

3) Imidazole derivatives described, for example, in JP-B-37-16096;

4) Polyarylalkane derivatives described, for example, in U.S. Pat. Nos. 3,615,402, 3,820,989 and 3,542,544, JP-B-45-555 and JP-B-51-10983 and JP-A-51-93224, JP-A-55-108667, JP-A-55-156953 and JP-A-56-36656;

5) Pyrazoline derivatives and pyrazolone derivatives described, for example, in U.S. Pat. Nos. 3,180,729 and 4,278,746 and JP-A-55-88064, JP-A-55-88065, JP-A-49-105537, JP-A-55-51086, JP-A-56-80015, JP-A-56-88141, JP-A-57-45545, JP-A-54-112637 and JP-A-55-74546;

6) Phenylenediamine derivatives described, for example, in U.S. Pat. No. 3,615,404, JP-B-51-10105, JP-B-46-3712 and JP-B-47-28336 and JP-A-54-83435, JP-A-54-110836 and JP-A-54-119925;

7) Arylamine derivatives described, for example, in U.S. Pat. Nos. 3,567,450, 3,180,703, 3,240,597, 3,658,520, 4,323,103, 4,175,961 and 4,012,376, West German Patent (DAS) No. 1,110,518, JP-B-49-35702 and JP-B-39-27577 and JP-A-55-144250, JP-A-56-119132 and JP-A-56-22437;

8) Amino-substituted chalcone derivatives described in U.S. Pat. No. 3,526,501;

9) N,N-Bicarbazyl derivatives described, for example, in U.S. Pat. No. 3,542,546;

10) Oxazole derivatives described, for example, in U.S. Pat. No. 3,257,203;

11) Styrylanthracene derivatives described, for example, in JP-A-56-46234;

12) Fluorenone derivatives described, for example, in JP-A-54-110837;

13) Hydrazone derivatives described, for example, in U.S. Patent 3,717,462 and JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144;

14) Benzidine derivatives described, for example, in U.S. Pat. Nos. 4,047,948, 4,047,949, 4,265,990, 4,273,846, 4,299,897 and 4,306,008;

15) Stilbene derivatives described, for example, in JP-A-58-190953, JP-A-59-95540, JP-A-59-97148, JP-A-59-195658 and JP-A-62-36674.

In addition to such low-molecular photoconductive compounds as those mentioned above, macromolecular compounds, for example the following, can also be used:

16) Polyvinylcarbazole and derivatives thereof described in JP-B-34-10966;

17) Polyvinylpyrene, polyvinylanthracene, poly-2-vinyl-4-(4'-dimethylaminophenyl)-5-phenyloxazole, poly-3-vinyl-N-ethylcarbazole and like vinyl polymers described in JP-B-43-18674 and JP-B-43-19192;

18) Polyacenaphthylene, polyindene, acenaphthylene-styrene copolymer and like polymers described in JP-B-43-19193;

19) Pyrene-formaldehyde resin, bromopyreneformaldehyde resin, ethylcarbazole-formaldehyde resin and like condensation resins described, for example, in JP-B-56-13940;

20) Various triphenylmethane polymers described in JP-A-56-90883 and JP-A-56-161550.

For improving the sensitivity of the photoconductive material or rendering said material photosensitive in a desired wavelength region, various pigments or sensitizing dyes, for instance, can be used. Examples are:

21) Monoazo, bisazo and trisazo pigments described, for example, in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-

61-148453 and JP-A-61-238063 and JP-B-60-5941 and JP-B-60-45664;

22) Phthalocyanine pigments, inclusive of metallophthalocyanines and metal-free phthalocyanines, described, for example, in U.S. Pat. Nos. 3,397,086 and 4,666,802;

23) Perylene pigments described, for example, in U.S. Pat. No. 3,371,884;

24) Indigo derivatives and thioindigo derivatives described, for example, in British Patent No. 2,237,680;

25) Quinacridone pigments described, for example, in British Patent No. 2,237,679;

26) Polycyclic quinone pigments described, for example, in British Patent No. 2,237,678 and JP-A-59-184348 and JP-A-62-28738;

27) Benzimidazole pigments described, for example, in JP-A-47-30331;

28) Squalium salt pigments described, for example, in U.S. Pat. Nos. 4,396,610 and 4,644,082;

29) Azulenium salt pigments described, for example, in JP-A-59-53850 and JP-A-61-212542; etc.

Usable as the sensitizing dyes are such known compounds that are described, for example, in "Zokanzai (Sensitizers)", page 125, Kodansha, 1987, or Denshi Shashin (Electrophotography), 12, 9 (1973), or Yuki Gosei Kagaku Kyokaishi (Journal of Synthetic Organic Chemistry), 24 (11), 1010 (1966). Thus for example, the following may be mentioned:

30) Pyrilium dyes described, for example, in U.S. Pat. Nos. 3,141,770 and 4,283,475, JP-B-48-25658 and JP-A-62-71965;

31) Triarylmethane dyes described, for example, in Applied Optics Supplements, 3, 50 (1969) and JP-A-50-39548;

32) Cyanine dyes described, for example, in U.S. Pat. No. 3,597,196;

33) Styryl dyes described, for example, in JP-A-60-163047, JP-A-59-164588 and JP-A-60-252517.

These may be used either alone or in combination, namely two or more of them may be used combinedly. Among these charge generators, those that have not only charge-generating ability but also charge-transporting ability can be used for photosensitive layer formation by dispersing such charge generators, respectively as basic ingredients, in a binder and using the resulting dispersions for coating. Thus, it is not always necessary to combinedly use a photoconductive organic compound ((e.g. any of the compounds described above under 1) to 20)) known as a charge transporter.

For sensitivity-improving and other purposes, the photoconductive layer to be formed in the practice of the invention may contain an electron-attracting compound, such as trinitrofluorenone, chloranil or tetracyanoethylene, or a compound described in JP-A-58-65439, JP-A-58-102239, JP-A-58-129439 or JP-A-62-71965, or the like.

The binder resin to be used in the electrophotographic printing plate precursor according to the invention may be any resin capable of being removed in the nonimage areas by dissolution after development with a toner. In etching, etching solutions based on an aqueous alkaline solution are preferred from the environmental pollution and handling viewpoints. Therefore, it is desirable that the binder resin should be removable with an aqueous alkaline solution. Thus, those alkali-soluble resins specifically mentioned hereinbefore as examples of the insulating resin to be applied to the cut-end faces can be used.

In the practice of the invention, the electrophotographic printing plate precursor can be produced by coating an aluminum substrate with a photoconductive layer in the conventional manner. Methods are known for photoconductive layer formation. Thus, for instance, the photoconductive layer constituents may be contained in one and the same layer or the charge carrier-generating substance may be contained in one layer and the charge carrier-transporting substance in another. Either mode can be suitably used.

The coating solution or composition is prepared by dissolving the photoconductive layer constituents in an appropriate solvent. When a pigment or the like ingredient insoluble in the solvent is used, the ingredient is dispersed in the solvent to a grain size of 5–0.1 μm using a dispersing machine such as a ball mill, paint shaker, Dyno mill or attriter. The binder resin for the photoconductive layer as well as other additives may be added to the pigment dispersion on the occasion of pigment dispersing or thereafter. The thus-prepared coating composition is applied to the substrate by any of the conventional methods, for example in the manner of roll coating, blade coating, knife coating, reverse-roll coating, dip coating, rod bar coating or spray coating, and then dried to give an electrophotographic printing plate precursor. Usable as the solvent for coating composition preparation are those various solvents mentioned hereinbefore as examples of the solvent for the insulating resin to be applied to the cut-end faces.

In the practice of the invention, the photoconductive layer may contain, in addition to the photoconductive compound and binder resin, various additives, such as plasticizers, surfactants, matting agents, etc., as necessary or where appropriate, for improving the softness and/or coat surface condition of the photoconductive layer or for other purposes. These additives may be used in amounts in which they will not adversely affect the electrostatic characteristics or etching behavior of the photoconductive layer.

When excessively thin, the photoconductive layer cannot be charged to a surface potential required for development. Conversely, when said layer is excessively thick, etching in the planar direction, called side etch, occurs at the time of removing the photoconductive layer, leading to unsatisfactory printing plates. Accordingly, the photoconductive layer should preferably have a thickness of 0.1–30 μm, more preferably 0.5–10 μm.

As regards the proportions of the binder resin and photoconductive compound in the photoconductive layer, the sensitivity is low when the content of the photoconductive compound is low. Therefore, the photoconductive compound should preferably be used in an amount of 0.05–1.2 parts by weight, more preferably 0.1–1.0 part by weight, per part by weight of the binder resin.

The electrophotographic printing plate precursor according to the invention may have, when necessary or where appropriate, an intermediate layer so that the adhesion of the photoconductive layer to the aluminum support, the electric characteristics or etching behavior of the photoconductive layer, and the printing characteristics, for instance, can be improved.

As the intermediate layer-forming material, there may be mentioned, for example, casein, polyvinyl alcohol, ethylcellulose, phenolic resin, styrene-maleic anhydride resin, polyacrylic acid, monoethanolamine, diethanolamine, triethanolamine, tripropanolamine, hydrochlorides or oxalates or phosphates of such alkanolamines; aminoacetic acid, alanine, other monoamino-monocarboxylic acids; serine, threonine, di-hydroxyethylglycine, other oxyamino acids; cysteine, cystine, other sulfur-containing amino acids; aspartic acid, glutamic acid, other monoamino-dicarboxylic acids; lysine, other diamino-monocarboxylic acids; p-hydroxyphenylglycine, phenylalanine, anthranilic acid, other aromatic nucleus-containing amino acids; tryptophan, proline, other heterocycle-containing amino acids; sulfamic acid, cyclohexylsulfamic acid; other aliphatic amino-sulfonic acids; ethylenediaminetetraacetic acid; nitrilotriacetic acid, iminodiacetic acid, hydroxyethyliminodiacetic acid, hydroxyethylethylenediaminetriacetic acid, ethylenediaminediacetic acid, cyclohexanediaminetetraacetic acid, diethylenetriaminepentaacetic acid, glycol ether diaminetetraacetic acid, other (poly)aminopolyacetic acids; and sodium, potassium, ammonium and other salts of such acids as resulting from partial or complete neutralization thereof.

If necessary or where appropriate, an overcoat layer removable in the step of etching of the photoconductive layer may be formed on the photoconductive layer for improving the electric characteristics of the photoconductive layer, the image characteristics at the time of development with a toner, or the adhesion of the toner, for instance. This overcoat resin layer may be mechanically matted or may contain a matting agent. The matting agent includes silicon dioxide, zinc oxide, titanium oxide, zirconium oxide, glass particles, alumina, starch, resin particles (e.g. polymethyl methacrylate, polystyrene, phenolic resin) and the matting agents described in U.S. Pat. No. 2,710,245 and 2,992,101. Two or more of these may be used in combination.

The resin to be used in the matting agent-containing resin layer can suitably be selected depending on the etching solution to be used. More specifically, there may be mentioned gum arabic, glue, gelatin, casein, celluloses (e.g. viscose, methylcellulose, ethylcellulose, hydroxyethylcellulose, hydroxypropylmethylcellulose, carboxymethylcellulose, etc.), starches (e.g. soluble starch, modified starches, etc.), polyvinyl alcohol, polyethylene oxide, polyacrylic acid, polyacrylamide, polyvinyl methyl ether, epoxy resins, phenolic resins (preferably novolak type phenolic resins), polyamide, and polyvinylbutyral. Two or more of these may be used in combination.

An electrophotographic printing plate according to the invention can be produced by a generally known process. Thus, the electrophotographic plate precursor is substantially uniformly charged in the dark and then exposed imagewise for forming electrostatic latent images. As the method of exposure, there may be mentioned, for example, scanning exposure using a semiconductor laser, He-Ne laser, etc., reflected image exposure using a xenon lamp, tungsten lamp, fluorescent lamp, etc. as a source of light, and contact exposure through a transparent positive film. The electrostatic latent images mentioned above are then developed with a toner. For the development, any of the various known techniques may be used, for example cascade development, magnetic brush development, powder cloud development, and liquid development. Among them, liquid development is particularly suited for producing printing plates since it can form detailed images. The toner images formed can be fixed by any of the known fixing methods, for example by heating, pressure application or treatment with a solvent. The thus-formed toner images are made to act as resists, the electrophotographic photosensitive layer in the nonimage areas is removed with an etching solution to give a printing plate.

The etching solution for removing the photoconductive insulating layer in the nonimage areas after toner image formation is not critical but any solvent capable of removing said photoconductive insulating layer may be used. Preferably, however, an alkaline solvent is used. The term "alkaline solvent" as used herein means an aqueous solution containing an alkaline compound, an organic solvent containing an alkaline compound, or a mixture composed of an aqueous solution containing an alkaline compound and ah organic solvent.

The alkaline compound may be any organic or inorganic alkaline compound selected from among sodium hydroxide, potassium hydroxide, sodium carbonate, sodium silicate, potassium silicate, sodium metasilicate, potassium metasilicate, sodium phosphate, potassium phosphate, ammonia, monoethanolamine, diethanolamine, triethanolamine, other aminoalcohols, etc. While water and a number of organic solvents can be used as the solvent in preparing etching solutions, water-based etching solutions are preferred from the odor and environmental pollution viewpoints, as mentioned above.

The water-based etching solutions may contain, if necessary or where appropriate, various organic solvents. As preferred organic solvents, there may be mentioned, among others, lower alcohols and aromatic alcohols, such as methanol, ethanol, propanol, butanol, benzyl alcohol, phenethyl alcohol, etc., ethylene glycol, diethylene glycol, triethylene glycol, polyethylene glycol, cellosolves, and amine-alcohols, such as monoethanolamine, diethanolamine, triethanolamine, etc.

When necessary, the etching solutions may contain various .additives, such as surfactants, antifoams, etc.

The toner for forming image areas is not critical in the practice of the invention but may be any toner resistant to the etching solutions mentioned above. Generally, however, the toner should preferably contain a resin component resistant to the etching solutions.

As the resin component, there may be mentioned acrylic resins based on methacrylic acid, acrylic acid, and/or methacrylate or acrylate ester or esters, polyvinyl acetate resins, copolymer resins from vinyl acetate and ethylene, vinyl chloride or the like comonomer, vinyl chloride resins, vinylidene chloride resins, vinylacetal resins such as polyvinylbutyral, polystyrene, copolymer resins from styrene and butadiene, a methacrylate ester and/or the like, polyethylene, polypropylene, chlorinated polyethylene or polypropylene, polyester resins (e.g. polyethylene terephthalate, polyethylene isophthalate, bisphenol A-derived polycarbonate, etc.), phenolic resins, xylene resins, alkyd resins, vinyl-modified alkyd resins, gelatin, carboxymethylcellulose, other cellulose derivatives, waxes, and polyolefins.

The following examples are further illustrative of the present invention. It is to be noted, however, that they are by no means limitative of the scope of the present invention. Unless otherwise specified, "%" and "part(s)" mean "% by weight" and "part(s) by weight", respectively.

EXAMPLE 1

A JIS 1050 aluminum sheet was grained (roughened) using a rotating nylon brush with a pumice suspension in water as an abrasive. The surface roughness (average center line roughness) attained was 0.5 μm. After washing with water, the aluminum sheet was immersed in a 10% aqueous sodium hydroxide solution at 70° C. and etching was conducted until the dissolution of aluminum amounted to 6 g/m$^2$. After washing with water, the sheet was immersed in 30% nitric acid for 1 minute for neutralization and then thoroughly washed with water. The sheet was then subjected to electrolytic surface roughening in 0.7% nitric acid for 20 seconds using a square wave alternating current (13 volts when the sheet served as an anode; 6 volts when it served as a cathode) (described in JP-B-55-19191), then immersed in 20% sulfuric acid at 50° C. for surface washing and then washed with water. Furthermore, the sheet was anodized in 20% sulfuric acid until the anodized film weight amounted to 3.0 g/m$^2$, then washed with water and dried to give a substrate.

A coating material having the composition specified below was applied to the above substrate for photoconductive layer formation using a bar coater and dried at 120° C. for 10 minutes to give an electrophotographic printing plate precursor.

| Coating composition (1) for photoconductive layer formation | |
|---|---|
| ε-Type copper phthalocyanine (Liophoton ERPC, product of Toyo Ink Manufacturing Co.) | 1.0 part |
| Benzyl methacrylate-methacrylic acid copolymer (methacrylic acid 30 mole percent) | 10.0 parts |
| Teterahydrofuran | 48.0 parts |
| Cyclohexanone | 16.0 parts |

The above ingredients were placed in a 300-ml glass vessel together with glass beads and subjected to dispersion treatment on a paint shaker (Toyo Seiki Seisakusho K.K.) for 60 minutes to give a dispersion for photoconductive layer formation.

The dried coat layer of the thus-prepared electrophotographic printing plate precursor had a thickness of 4 μm.

A number of electrophotographic photosensitive sheets prepared in this manner were piled up with a polyethylene-laminated paper (produced by laminating a 10 μm-thick polyethylene layer to one side of a paper having a basis weight of 50 g/m$^2$) inserted between each two neighboring sheets with the polyethylene layer in contact with the photosensitive layer, and cut to a desired size using a guillotine cutter, and the peripheral cut-end faces were coated with a hydrophilic resin solution having the composition (1) specified below using a sponge in a coating amount of about 70 g/m$^2$, followed by drying at room temperature.

| Hydrophilic resin solution (1) | |
|---|---|
| Hydroxypropyl-etherified starch (substitution degree 0.05) | 60 parts |
| Potassium silicate solution (52 Be at 20° C.) | 18 parts |
| Potassium hydroxide (48.5%) | 8 parts |
| Pure water | 914 parts |

The samples thus obtained were then charged in the dark to a surface potential of +400 V using a corona charger, then imagewise exposed through a negative using a tungsten lamp, and subjected to reversal development (bias voltage +300 V) using a liquid developer prepared by the procedure mentioned below, whereby distinct positive images could be obtained. The toner images thus produced were fixed by heating at 120° C. for 2 minutes.

Liquid Developer Preparation

A reaction vessel equipped with a reflux condenser, a blade stirrer and a nitrogen inlet was charged with 200 g of toluene, 50 g of methyl methacrylate, 40 g of n-octyl methacrylate, 106 g of styrene and 4 g of N,N-dimethylethyl methacrylate. The contents were heated to 70° C. in a nitrogen stream, then the polymerization initiator 2,2'-azobis(2,4-dimethylvaleronitrile) was added in an amount of 1 mole percent relative to the monomers mentioned above, and polymerization was carried out at 70° C. for 6 hours. Then, 8 g of methyl p-toluenesulfonate was added, and heating was continued for 1 hour. The reaction mixture was cooled to room temperature, and the polymer was precipitated with 5 liters of methanol. The precipitate was dried in vacuo at 50° C. to give a copolymer resin.

This resin was ground in a sample mill (average diameter: scores of micrometers). One part (by weight) of the resin was admixed with 10 parts of a 5% (by weight) solution of the styrene-butadiene copolymer Sorprene 1205 (St/Bu ratio 25/75 by weight, product of Asahi Chemical Industry) in Isopar H (isoparaffin hydrocarbon solvent, product of Exxon Co.), and the mixture was subjected to preliminary dispersion on a paint shaker (Toyo Seiki Seisakusho K.K.) for 20 minutes using glass beads (4–5 mm in diameter) and then to wet dispersion in a Dyno mill (Shinmaru Enterprise Co.) for 2 hours using glass beads (about 1 mm in diameter) as media.

A 20-g portion of this dispersion was diluted with 1 liter of a $5\times10^{-7}$ M solution of zirconium naphthenate in Isopar G to give a positively chargeable liquid developer.

The nonimage areas were removed using an etching solution composed of 40 parts of potassium silicate, 10 parts of potassium hydroxide, 100 parts of ethanol and 800 parts of water. The plates were then thoroughly washed with water and then coated with a gum solution (Gum GU-7 for PS plates, product of Fuji Photo Film Co., Ltd.) to give offset printing plates.

Each sample printing plate was mounted on an offset press and printing was carried out. All the prints obtained were satisfactory without any staining even in those regions corresponding to the end portions of the printing plate.

EXAMPLE 2

An insulating resin solution having the composition (1) specified below was further applied to the cut-end faces of the photosensitive plate precursors obtained by the procedure of Example, 1 after application of the water-soluble resin, using a sponge in a coating amount of about 70 g/m$^2$, and the coats were dried at room temperature.

| Insulating resin solution (1) | |
|---|---|
| Benzyl methacrylate-methacrylic acid copolymer (methacrylic acid 30 mole percent) | 10.0 parts |
| Methylcellosolve acetate | 90.0 parts |

The photosensitive material samples thus obtained were processed in the same manner as in Example 1 for toner development. The toner adhesion to the end faces was less as compared with Example 1 and the end face treatment in the etching step was easier.

Using the resultant printing plates, printing was performed in the same manner as in Example 1. All the prints obtained were satisfactory without any staining even in those regions corresponding to the end portions of the printing plates.

COMPARATIVE EXAMPLE 1

Printing plates were produced in the same manner as in Example 1 except that the application of the hydrophilic resin solution (1) to the end faces was omitted.

Using these printing plates, printing was conducted in the same manner as in Example 1. The prints obtained were free from staining in the image regions but had stripy stains in the regions corresponding to the end portions of the printing plates, hence the printing plates were not suited for practical use.

EXAMPLE 3

Printing plates were prepared in the same manner as in Example 1 except that the hydrophilic resin solution (2) mentioned below was used in lieu of the hydrophilic resin solution (1). All the prints obtained were satisfactory without any staining even in the regions corresponding to the end portions of the printing plates.

| Hydrophilic resin solution (2) | |
|---|---|
| Sodium polyacrylate | 40 parts |
| Potassium silicate (52 BE at 20° C.) | 20 parts |
| Potassium hydroxide (48.5%) | 10 parts |
| Sodium butylnaphthalenesulfonate | 5 parts |
| Pure water | 925 parts |

EXAMPLE 4

An insulating resin solution having the composition (2) specified below was further applied to the cut-end faces of the photosensitive plate precursors obtained by the procedure of Example 3 after application of the hydrophilic resin solution (2), using a sponge in a coating amount of about 70 g/m$^2$, and the coats were dried at room temperature.

With the plates thus obtained, the toner adhesion to the cut end faces of the printing plates in the step of toner development was slight and all the prints obtained were satisfactory without any staining even in the regions corresponding to the end portions of the printing plates.

| Insulating resin solution (2) | |
|---|---|
| Butyl methacrylate-methacrylic acid copolymer (methacrylic acid 40 mole percent) | 10.0 parts |
| Methylcellosolve acetate | 90.0 parts |

EXAMPLE 5

Electrophotographic printing plate precursors were produced in the same manner as in Example 1 except that the photoconductive coating composition (2) mentioned below was used in lieu of the photoconductive coating composition (1).

| Coating composition (2) for photoconductive layer formation | |
|---|---|
| Trisazo compound | 1.0 part |

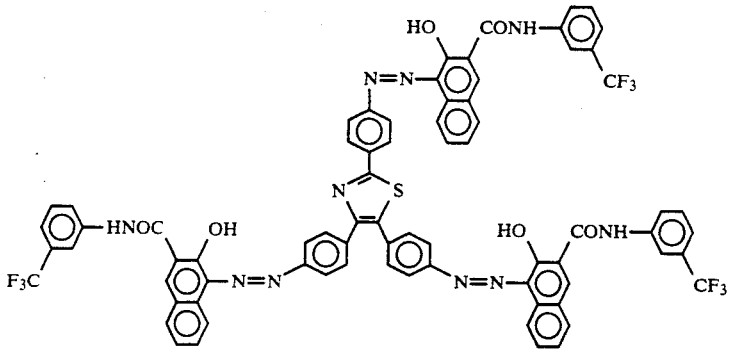

| | |
|---|---|
| Oxazole compound | 2.5 parts |

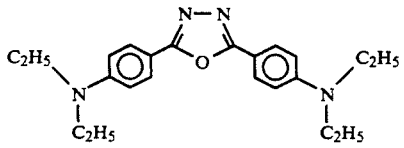

| | |
|---|---|
| Vinyl acetate-crotonic acid copolymer (RESYN No. 28-1310, product of Kanebo NSC Co.) | 10 parts |
| Tetrahydrofuran | 100 parts |

The above ingredients were placed in a 500-ml glass container together with glass beads and dispersion was performed on a paint shaker (Toyo Seiki Seisakusho K.K.) for 60 minutes to give a dispersion for photocondutive layer formation.

The photoconductive layer had a thickness of about 4 μm. The hydrophilic resin solution (3) mentioned below was applied to the cut end faces of the photosensitive plate precursors in the same manner as in Example 1 using a sponge in an amount of about 50 g/m$^2$. The coats were dried at room temperature.

| Hydrophilic resin solution (3) | |
|---|---|
| Cream dextrin with a water-soluble matter content of not less than 95% by weight (Cream Dextrin #3, product of Matsutani Kagaku K.K.) | 100 parts |
| Potassium silicate (52 Be at 20° C.) | 20 parts |
| Potassium hydroxide (48.5%) | 10 parts |
| Sodium isopropylnaphthalenesulfonate | 5 parts |
| Pure water | 865 parts |

The sample plate precursors thus obtained were charged in the dark to a surface potential of +400 V using a corona charger and then imagewise exposed through a positive using a tungsten lamp, followed by development (bias voltage +50 V), with the liquid developer Ricoh MRP (Ricoh Co.), whereby distinct positive images could be obtained. The toner images produced were further fixed by heating at 120° C. for 2 minutes.

The nonimage areas were removed by immersing the plates in an etching solution prepared by 1:2 dilution of DN-3C (developer for PS plates, product of Fuji Photo Film Co., Ltd.) with water for 10 seconds. The plates were thoroughly washed with water and coated with a gum solution (Gum GU-7 for PS plates, product of Fuji Photo Film Co., Ltd.) to give offset printing plates.

Each sample printing plate was mounted on an offset press and printing was carried out. All the prints obtained were satisfactory without any staining even in the regions corresponding to the end portions of the printing plates.

EXAMPLE 6

Printing plates were produced in the same manner as in Example 5 except that the hydrophilic resin solution (4) mentioned below was used in lieu of the hydrophilic resin solution (3). All the prints obtained were satisfactory without any staining in the regions corresponding to the end portions of the printing plates.

| Hydrophilic resin solution (4) | |
|---|---|
| Carboxymethylated starch (carboxymethyl group introduction degree 0.2) | 100 parts |
| Potassium silicate (52 Be at 20° C.) | 20 parts |
| Potassium hydroxide (48.5%) | 10 parts |
| Sodium isopropyl naphthalenesulfonate | 5 parts |
| Pure water | 865 parts |

EXAMPLES 7

The following insulating resin solution (3) was further applied to the cut-end faces of the photosensitive plate precursors obtained in Example 5 after application of the hydrophilic resin solution (3).

| Insulating resin solution (3) | |
|---|---|
| Vinyl acetate-crotonic acid copolymer (RESYN No. 28-1310, product of Kanebo NSC Co.) | 10 parts |

-continued

| Insulating resin solution (3) | |
|---|---|
| Tetrahydrofuran | 100 parts |

The sample photosensitive plate precursors were then charged in the dark to a surface potential of +400 V using a corona charger and then imagewise exposed through a negative using a tungsten lamp. After reversal development (bias voltage +300 V) using the same liquid developer as used in Example, 1 gave distinct positive images. The toner images produced were further fixed by heating at 120° C. for 2 minutes.

The nonimage areas were removed by immersing the plates in an etching solution prepared by 1:2 dilution of DN-3C (developer for PS plates, product of Fuji Photo Film Co., Ltd.) with water for 10 seconds. The plates were then thoroughly washed with water and then coated with a gum solution (Gum GU-7 for PS plates, product of Fuji Photo Film Co., Ltd.) to give offset printing plates.

Each sample printing plate was mounted on an offset press and printing was performed. All the prints obtained were satisfactory without any staining even in the regions corresponding to the end portions of the printing plates.

COMPARATIVE EXAMPLE 2

Printing plates were produced in the same manner as in Example 5 except that the application of the hydrophilic resin solution (2) to the cut end faces of the photosensitive plate precursors was omitted.

Using the printing plates obtained, printing was carried out as in Example 5. The prints obtained were free from staining in the image regions but had stripy stains in the regions corresponding to the end portions of the printing plates, hence the printing plates were not suited for practical use.

EXAMPLE 8

Electrophotographic printing plate precursors prepared in the same manner as in Example 1 were piled up and cut to a desired size using a guillotine cutter. An addition-reactive silicone solution having the composition (1) shown below was applied to the peripheral cut-end faces of the resulting plate precursors and dried at 120° C. for 5 minutes, whereby a 3-μm-thick polysiloxane polymer layer was formed.

| Addition-reactive silicone solution (1) | |
|---|---|
| (1) SD 7226 (Toray Silicone) | 100 parts |
| (2) SRX-212 (Toray Silicone) | 0.9 parts |
| (3) Toluene | 250 parts |
| (4) n-Hexane | 250 parts |

The sample photosensitive plate precursors thus obtained were charged in the dark to a surface potential of +400 V, then imagewise exposed through a negative using a tungsten lamp, and subjected to reversal development using a liquid developer (prepared by dispersing 5 g of polymethyl methacrylate particles (particle size 0.3 μm) as toner particles in 1 liter of Isopar H (Esso Standard Co.) and adding 0.01 g of zirconium naphthenate as a charge control agent) and applying a bias voltage of +300 V to the counter electrode. Distinct positive images could be obtained. The toner images produced were further fixed by heating at 120° C. for 2 minutes.

The nonimage areas were removed using an etching solution composed of 40 parts of potassium silicate, 10 parts of potassium hydroxide, 100 parts of ethanol and 800 parts of water. The plates were then thoroughly washed with water and coated with a gum solution (Gum GU-7 for PS plates, product of Fuji Photo Film Co., Ltd.) to give offset printing plates.

Each sample printing plate was mounted on an offset press and printing was performed. All the prints obtained were satisfactory without any staining even in the regions corresponding to the end portions of the printing plates.

COMPARATIVE EXAMPLE 3

Printing plates were produced in the same manner as in Example 8 except that the formation of the polysiloxane polymer-containing layer on the cut end faces was omitted.

Using these printing plates, printing was performed as in Example 8. The prints obtained were free from staining in the image regions but had stripy stains in the regions corresponding to the end portions of the printing plates, hence the printing plates were not suited for practical use.

COMPARATIVE EXAMPLE 4

Printing plates were produced in the same manner as in Example 8 except that a 3-μm-thick layer containing an isobutyl methacrylate-methacrylic acid copolymer (mole ratio 8:2) as an insulating resin was formed on the cut end faces instead of the polysiloxane polymer-containing layer.

Using these printing plates, printing was performed as in Example 8. The prints obtained were satisfactory without any staining in the image regions but had stripy stains in the regions corresponding to the end portions of the printing plates, hence the printing plates were not suited for practical use.

EXAMPLE 9

Electrophotographic printing plate precursors were prepared in the same manner as in Example 8 except that a 4-μm-thick polysiloxane polymer-containing layer was formed by applying a condensation-reactive silicone solution having the composition (2) given below, which was used in lieu of the addition-reactive silicone solution (1), to the cut end faces of the plate precursors, followed by drying at 50° C. for 5 minutes. Platemaking and printing were carried out in the same manner as in Example 8. All the prints obtained were satisfactory without any staining even in the regions corresponding to the end portions of the printing plates.

| Condensation-reactive silicone solution (2) | |
|---|---|
| (1) Dimethylpolysiloxane (number average molecular weight 50,000) | 83 parts |
| (2) Methyltriacetoxysilane | 8.5 parts |
| (3) Dibutyltin acetate | 0.5 part |
| (4) n-Hexane | 250 parts |

EXAMPLE 10

Electrophotographic photosensitive plate precursors prepared in the same manner as in Example 8 by forming a photoconductive layer were piled up with a polyethylene-laminated paper (produced by laminating a 10-μm-thick polyethylene layer to one side of a paper having a basis weight of 50 g/m$^2$) inserted between each two neighboring plate precursors with the polyethylene layer in contact with the photosensitive layer, and cut to a desired size using a guillotine cutter. The same silicate-containing hydrophilic resin solution (1) as used in Example 1 was applied to the cut end faces of the resulting plate precursors using a sponge in a coating amount of about 70 g/m$^2$. The coats were dried at room temperature.

A silicone gum solution having the composition (3) given below was applied to the end faces, followed by drying at 50° C. for 10 minutes, which gave a 5-μm-thick polysiloxane polymer layer.

| Silicone gum solution (3) | |
|---|---|
| (1) Dimethylpolysiloxane (number average molecular weight 50,000) | 100 parts |
| (2) Vinyltri(methyl ethyl ketoxime)silane | 10 parts |
| (3) Dibutyltin diacetate | 0.5 part |
| (4) n-Hexane | 400 parts |

The sample plate precursors thus obtained were subjected to platemaking in the same manner as in Example 8. The printing plates obtained were each mounted on an offset press and printing was performed. All the prints obtained were satisfactory without any staining even in the regions corresponding to the end portions of the printing plates.

EXAMPLE 11

Photosensitive plate precursors were prepared in the same manner as in Example 8 and coated with the following solution (1) for desensitization treatment, which solution was used in lieu of the silicate-containing hydrophilic resin composition, on the cut end faces thereof by spray coating in a coating amount of about 70 g/m$^2$. The coats were dried at room temperature.

| Desensitizing solution (1) | |
|---|---|
| 30% Aqueous gum arabic solution | 61 parts |
| Water | 30 parts |
| Sodium hexametaphosphate | 0.7 part |
| Sodium nitrate | 1.0 parts |
| Magnesium sulfate | 1.2 parts |
| 85% Phosphoric acid | 2.4 parts |
| Polyoxyethylene-polyoxypropylene block copolymer (trade name Pluronic) | 1.2 parts |

A 4-μm-thick polysiloxane polymer-containing layer was formed on this desensitizing layer by applying a silicone solution having the composition (4) shown below.

| Silicone solution (4) | |
|---|---|
| (1) Dimethylpolysiloxane (number average molecular weight 20,000) | 100 parts |
| (2) Vinyltriacetoxysilane | 15 parts |
| (3) Dibutyltin diacetate | 8 parts |
| (4) n-Hexane | 1,000 parts |

The sample photosensitive plate precursors thus obtained were subjected to platemaking in the same manner as in Example 8. Each sample printing plate was mounted on an offset press and printing was carried out. All the prints obtained were satisfactory without any staining even in the regions corresponding to the end portions of the printing plates.

EXAMPLE 12

Electrophotographic printing plate precursors were prepared in the same manner as in Example 8 except that the same photoconductive coating composition (2) as used in Example 5 was used in lieu of the photoconductive coating composition (1).

The photoconductive layer had a thickness of about 4 μm. The following silicate-containing hydrophilic resin solution (5) specified below was applied to the peripheral cut-end faces of the plate precursors in an amount of 50 g/m$^2$ in the same manner as in Example 10.

| Silicate-containing hydrophilic resin solution (5) | |
|---|---|
| Cream dextrin with a water-soluble matter content of not less than 95% by weight (Cream Dextrin #3, product of Matsutani Kagaku K.K.) | 100 parts |
| Potassium silicate (52 Be at 20° C.) | 20 parts |
| Potassium hydroxide (48.5%) | 10 parts |
| Sodium isopropylnaphthalenesulfonate | 5 parts |
| Pure water | 865 parts |

Then, a 3.5-μm-thick polysiloxane-containing layer was formed on this silicate-containing hydrophilic resin layer by applying a silicone rubber solution having the composition (5) shown below, followed by drying.

| Silicone rubber solution (5) | |
|---|---|
| Dimethylpolysiloxane having vinyl groups on both ends (molecular weight about 35,000) | 100 parts |
| Methylhydrogenpolysiloxane having trimethylsilyl groups on both ends (molecular weight about 2,5000) | 3 parts |
| Olefin-chloroplatinic acid catalyst (10% toluene solution) | 2 parts |
| Isopar G (Esso chemical Co.) | |

The thus-obtained sample plate precursors were charged in the dark to a surface potential of +400 V using a corona charger and then imagewise exposed through a positive using a tungsten lamp. Development (bias voltages +50 V) with the liquid developer Ricoh MRP (Ricoh Co.) gave distinct positive images. The toner images produced were fixed by heating at 120° C. for 2 minutes.

The nonimage areas were removed by immersing the plates in an etching solution prepared by 1:2 dilution of DN-3C (developer for PS plates, product of Fuji Photo Film Co., Ltd.) with water for 10 seconds. The plates were then thoroughly washed with water and coated with a gum solution (Gum GU-7 for PS plates, product of Fuji Photo Film Co., Ltd.) to give offset printing plates.

Each sample printing plate was mounted on an offset press and printing was performed. All the prints obtained were satisfactory without any staining even in the regions corresponding to the end portions of the printing plates.

EXAMPLE 13

Printing plates were produced in the same manner as in Example 12 except that a solution for desensitizing treatment, which had the composition (2) shown below, was used in lieu of the silicate-containing hydrophilic resin solution (5). All the prints obtained were satisfactory without any staining even in the regions corresponding to the end portions of the printing plates.

| Desensitizing solution (2) | |
|---|---|
| Carboxymethylated starch (carboxymethyl group introduction degree 0.2) | 100 parts |
| Potassium silicate (52 Be at 20° C.) | 20 parts |
| Potassium hydroxide (48.5%) | 10 parts |
| Sodium isopropylnaphthalenesulfonate | 5 parts |
| Pure water | 865 parts |

EXAMPLE 14

A mechanically grained 28 aluminum plate having a thickness of 0.3 mm was immersed in a 2% aqueous sodium hydroxide solution maintained at 40° C. for 1 minute for partial surface erosion. After washing with water, it was immersed in a sulfuric acid-chromic acid mixture for about 1 minute for exposure of the pure aluminum surface. Then it was immersed in 20% sulfuric acid maintained at 30° C. and anodized at a direct current voltage of 1.5 V and a current density of 3 A/dm$^2$ for 2 minutes, then washed with water and dried. A photosensitive coating material having the composition shown below was continuously applied to the plate in an amount of 2 g/m$^2$ on the dried basis using a roll coater. The coat was dried at 100° C. for 2 minutes, whereby a positive-type PS plate (precursor) was prepared.

| | |
|---|---|
| Napthoquinone-1,2-diazide(2)-5-sulfonic acid ester of acetone-pyrogallol resin (synthesized by the procedure of Example 1 of U.S. Pat. No. 3,635,709) | 5 g |
| PR-50530 (tert-butylphenol-formaldehyde resin, product of Sumitomo Durez K.K.) | 0.5 g |
| Hitanol #3110 (cresol-formaldehyde resin, product of Hitachi Chemical Co.) | 5 g |
| Methyl ethyl ketone | 50 g |
| Cyclohexanone | 40 g |

Fifty PS plates prepared by the above produced were piled up with a polyethylene-laminated paper (produced by laminating a 10-μm-thick polyethylene layer to one side of a paper having a basis weight of 50 g/m$^2$) inserted between each two neighboring plates with the polyethylene layer of the laminate in contact with the photosensitive layer, and cut to a size of 1,310×800 mm using a guillotine cutter. The hydrophilic resin solution of Example 1 was applied to the peripheral cut end faces of the piled plates using a sponge in a coating amount of 70 g/m$^2$. The coats were dried at room temperature.

The above PS plates were each mounted on a vaccum printing frame and exposed through a transparent positive film for 30 seconds from a distance of 1 m using a Fuji Film PS light (having a Toshiba model MU2000-2-OL metal halide lamp, 3 kW, as the light source; distributed by Fuji Photo Film Co., Ltd.). The plates were then immersed in a developer having the following composition, for development:

| | |
|---|---|
| JIS No. 3 sodium silicate | 10 g |
| Aerosol OS (sodium isopro pylnaphthalene-sulfonate, product of American Cyanamid Co.) | 20 g |
| Benzyl alcohol | 30 g |
| Water to make | 1,000 ml |

The plates were then gummed with an aqueous solution of gum arabic (14° Baume). Two of the printing plates thus prepared were mounted side by side on a rotary offset press and printing was carried out in the conventional manner. The prints thus obtained were satisfactory without any staining even in the regions corresponding to the end portions of the printing plates.

For comparison, the above procedure was followed without applying the hydrophilic resin solution (1) to the peripheral end faces of the PS plates mentioned above. The prints obtained had stains in the regions that had contacted with the end portions of the printing plates.

EXAMPLE 15

A 0.15-mm-thick aluminum plate was defatted with an aqueous solution of sodium phosphate, then electrolytically polished in a hydrochloric acid bath at a current density of 4 $A/m^2$, and anodized in a sulfuric acid bath. The plate was further treated with an aqueous solution of sodium metasilicate for sealing to give an aluminum base plate for lithographic printing. A photosensitive composition having the composition shown below was applied to that aluminum plate using a whaler. The subsequent drying at 100° C. for 2 minutes resulted in the formation of 2.5 $g/m^2$ of a photosensitive layer.

| Photosensitive composition | |
|---|---|
| Copolymer 1 | 5.0 g |
| Hexafluorophosphate of p-diazodiphenylmaine-form-aldehyde condensate | 0.5 g |
| Victoria pure blue BOH (Hodogaya Chemical Co.) | 0.1 g |
| Cellulose ethyl ether | 0.2 g |
| Tricresyl phosphate | 0.5 g |
| Methylcellosolve | 95 ml |
| Water | 5 ml |

The above-mentioned copolymer 1 had the following composition (by weight): p-hydroxyphenylmethacrylamide/2-hydroxyethyl methacrylate/acrylonitirile/methyl methacrylate/methacrylic acid=10/20/25/35/10. Its average molecular weight was 60,000.

A number of PS plates (precursor) prepared in this manner were piled up and cut in the same manner as in Example 14, and the same hydrophilic resin solution (2) as used in Example 3 was applied to the peripheral cut-end face of the PS plates in the same manner as in Example 14.

The PS plates were exposed through a transparent negative film for 40 seconds from a distance of 1 m using a 3 kW metal halide lamp, then immersed in the developer mentioned below and wiped lightly with a sponge for development.

The plates were gummed with an aqueous solution of gum arabic (14° Baume) and two of the printing plates thus prepared were mounted side by side on a rotary offset press. Printing was performed in the conventional manner. The prints thus obtained were satisfactory without any staining even in the regions corresponding to the end portions of the printing plates.

| Developer | |
|---|---|
| Benzyl alcohol | 30 ml |
| Sodium carbonate | 5 g |
| Sodium sulfite | 5 g |
| Sodium dodecylbenzenesulfonate | 10 g |
| Water | 1 liter |

EXAMPLES 16–19

Lithographic printing plates were produced in the same manner as in Example 14 or 15 except that the hydrophilic resin solution (3) of Example 5 or the hydrophilic resin solution (40 of Example 6 was used in lieu of the hydrophilic resin solution used in Example 14 or 15.

Each of the printing plates prepared was mounted on an offset press and printing was performed. All the prints obtained were satisfactory without any staining even in the regions corresponding to the end portions of the printing plates.

While the invention has been described in detail and with reference to specific embodiments thereof, it will be apparent to one skilled in the art that various changes and modifications can be made therein without departing from the spirit and scope thereof.

What is claimed is:

1. An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that a layer containing a polymer having at least a polysiloxane structure is formed at the end face of the plate precursor.

2. An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that a solution containing a silicate of formula: $mSi_2/n\text{-}M_2O$ (wherein M is an alkali metal atom and the ratio of m/n is 0.5 to 8.5) and a hydrophilic resin is coated on the end face of the plate precursor and further a layer containing at least a polysiloxane structure is formed thereon.

3. An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that the end face of the plate precursor is desensitized and further a layer containing at least a polysiloxane structure is formed thereon.

4. An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that an aqueous solution containing a silicate of formula: $mSiO_2/nM_2O$ (wherein M is an alkali metal atom and the ratio of m/n is 0.5 to 8.5) and a hydrophilic resin is coated on the end face of the plate precursor.

5. An electrophotographic printing plate precursor comprising a photoconductive layer on a conductive support having a hydrophilic surface, wherein a printing plate is prepared by imagewise exposure, toner image formation by development with a toner and removal of the photoconductive layer in the nonimage areas other than the toner image areas, characterized in that an aqueous solution containing a silicate of formula: $mSiO_2/nM_2O$ (wherein M is an alkali metal atom and the ratio of m/n is 0.5 to 8.5) and a hydrophilic resin is coated on the end face of the plate precursor and further an insulating resin is coated thereon.

6. A photosensitive lithographic printing plate precursor comprising a photosensitive layer on a conductive support having a hydrophilic surface, characterized in that an aqueous solution containing a silicate of formula: $mSiO_2/nM_2O$ (wherein M is an alkali metal atom and the ratio of m/n is 0.5 to 8.5) and a hydrophilic resin is coated on the end face of the plate precursor.

7. An electrophotographic printing plate precursor as in claim 1, wherein said polymer having at least a polysiloxane structure is a block copolymer, a graft copolymer, or a copolymer composed of polysiloxanes and polymers other than polysiloxanes.

8. An electrophotographic printing plate precursor as in claim 7, wherein said polymer having at least a polysiloxane structure comprises at least one of silicone oils, organic modified silicone oils, silicone greases, silicone rubbers, and silicone resins.

9. An electrophotographic printing plate precursor as in claim 1, wherein said layer containing a polymer having at least a polysiloxane structure comprises a linear polymer having a repeating unit of the formula

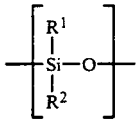

wherein $R^1$ and $R^2$ each is a hydrogen atom or an unsubstituted or substituted $C_{1-10}$ alkyl, vinyl, $C_{6-20}$ aryl, or $C_{7-20}$ aralkyl group.

10. An electrophotographic printed plate precursor as in claim 9, wherein the substituents for $R^1$ and $R^2$ are selected from the group consisting of amino, epoxy, carboxy, mercapto, hydroxyl, halogen, polyhalo alkyl, vinyl, and polyether structure-containing groups.

11. An electrophotographic printing plate precursor as in claim 9, wherein said polymer having at least a polysiloxane structure is a silicone rubber or silicone resin, and said polymer is three-dimensionally cross-linked.

12. An electrophotographic printing plate precursor as in claim 11, wherein said three-dimensionally cross-linked polymer is synthesized by condensation cross-linking, and wherein said condensation is carried out in the presence of a condensation-type cross-linking agent represented by the formula $$R_mSiX_n$$

wherein m and n are integers, provided that $m+n=4$ and $n \geqq 1$, R is a hydrogen atom or an unsubstituted or substituted $C_{1-10}$ alkyl, vinyl, $C_{6-20}$ aryl or $C_{7-20}$ aralkyl group, and X is a substituent selected from (1) a halogen atom, (2) OH or an organic functional group,

13. An electrophotographic printing plate precursor as in claim 2, wherein said hydrophilic resin is selected from the group consisting of naturally occurring starches and modified starches.

14. An electrophotographic printing plate precursor as in claim 2, wherein said hydrophilic resin is an algal resin.

15. An electrophotographic printing plate precursor as in claim 2, wherein said hydrophilic resin is selected from the group consisting of plant-derived mucilages and modified mucilages.

16. An electrophotographic printing plate precursor as in claim 2, wherein said hydrophilic resin is a protein.

17. An electrophotographic printing plate precursor as in claim 2, wherein said hydrophilic resin is a cellulose derivative.

18. An electrophotographic printing plate precursor as in claim 2, wherein said hydrophilic resin is a synthetic polymer.

19. An electrophotographic printing plate precursor as in claim 14, wherein said mucilage, mannan, quince seed, pectin, tragacanth gum, karaya gum, xanthan gum, guar bean gum, locust bean gum, gum arabic, carob gum, and gum benzoin.

20. An electrophotographic printing plate precursor as in claim 15, wherein said mucilage is selected from the group consisting of gum arabic, carob gum, and gum benzoin.

21. An electrophotographic printing plate precursor as in claim 15, wherein said modified starches are selected from the group consisting of acid-processed starches, oxidized starches, alpha-form starches, starch esters, cross-linked starches, and starch-derived graft copolymers.

22. A photosensitive lithographic printing plate precursor as in claim 6, wherein said hydrophilic resin is selected from the group consisting of naturally occurring starches and modified starches.

23. A photosensitive lithographic printing plate precursor as in claim 6, wherein said hydrophilic resin is an algal resin.

24. A photosensitive lithographic printing plate precursor as in claim 6, wherein said hydrophilic resin is selected from the group consisting of plant-derived mucilages and modified mucilages.

25. A photosensitive lithographic printing plate precursor as in claim 6, wherein said hydrophilic resin is a protein.

26. A photosensitive lithographic printing plate precursor as in claim 6, wherein said hydrophilic resin is a cellulose derivative.

27. A photosensitive lithographic printing plate precursor as in claim 6, wherein said hydrophilic resin is a synthetic polymer.

28. A photosensitive lithographic printing plate precursor as in claim 6, wherein said mucilage, mannan, quince seed, pectin, tragacanth gum, karaya gum, xanthan gum, guar gum, locust bean gum, gum arabic, carob gum, and gum benzoin.

29. A photosensitive lithographic printing plate precursor as in claim 6, wherein said mucilage is selected from the group consisting of gum arabic, carob gum, and gum benzoin.

30. A photosensitive lithographic printing plate precursor as in claim 6, wherein said modified starches are selected from the group consisting of acid-processed starches, oxidized starches, alpha-form starches, starch esters, cross-linked starches, and starch-derived graft copolymers.

31. An electrophotographic printing plate precursor as in claim 3, wherein said printing plate precursor is desensitized with a hydrophilic organic macromolecular compound selected from the group consisting of gum arabic, dextrin, alginates, water-soluble cellulose derivatives, polyvinyl alcohol, polyvinylpyrrolidone, polyacrylamide, acrylamide unit-containing water-soluble copolymers, polyacrylic acid, acrylic acid unit-containing copolymers, polymethacrylic acid, methacrylic acid unit-containing copolymers, vinyl methyl ether-maleic anhydride copolymer, vinyl acetate-maleic anhydride copolymer, and phosphoric acid-modified starch.

32. An electrophotographic printing plate precursor as in claim 30, wherein said hydrophilic organic macromolecular compound is gum arabic.

33. An electrophotographic printing plate precursor as in claim 31, wherein said hydrophilic organic macromolecular compound is present in amount of from 50 to 150 $g/m^2$.

34. An electrophotographic printing plate precursor as in claim 5, wherein said insulating resin is an alkali-soluble resin that is soluble in an etching solution and is selected from the group consisting of (1) copolymers of (a) acrylate esters, methacrylate esters, styrene, and vinyl acetate with (b) a carboxy-containing monomer or acid anhydride group-containing monomer, or (2) copolymers containing methacrylamide, vinylpyrrolidone or a monomer having a phenolic hydroxy group, sulfone group, sulfonamido group or a sulfonimido group, phenolic resins, partially saponified vinyl acetate resins, xylene resins, polyvinylbutyral, and other vinyl acetal resins.

35. An electrophotographic printing plate precursor as in claim 5, wherein the content of said hydrophilic resin in said silicate-anhydrophilic resin-containing aqueous solution is within a range of about 1–30% by weight.

* * * * *